US007062064B2

(12) United States Patent
Bachmann et al.

(10) Patent No.: US 7,062,064 B2
(45) Date of Patent: Jun. 13, 2006

(54) FLAT PANEL LOUDSPEAKER ARRANGEMENT

(75) Inventors: Wolfgang Bachmann, Grevenbroich (DE); Gerhard Krump, Schwarzach (DE); Hans-Juergen Regl, Regensburg (DE); Andreas Ziganki, Mettmann (DE)

(73) Assignee: Harman Audio Electronic Systems GmbH, Straubing (DE)

( * ) Notice: Subject to any disclaimer, the term of this patent is extended or adjusted under 35 U.S.C. 154(b) by 699 days.

(21) Appl. No.: 09/756,556

(22) Filed: Jan. 8, 2001

(65) Prior Publication Data

US 2001/0017927 A1 Aug. 30, 2001

(30) Foreign Application Priority Data

Jan. 14, 2000 (DE) ..... 100 01 410

(51) Int. Cl.
*H04R 25/00* (2006.01)

(52) U.S. Cl. ..... 381/431; 381/152; 381/425; 381/182

(58) Field of Classification Search ..... 381/152, 381/337, 353, 354, 182, 186, 431, 345, 348, 381/349, 396, 425, 424; 181/164–166, 163
See application file for complete search history.

(56) References Cited

U.S. PATENT DOCUMENTS

| | | | | |
|---|---|---|---|---|
| 3,347,335 | A * | 10/1967 | Watters et al. | 381/354 |
| 3,509,290 | A * | 4/1970 | Ishimura et al. | 381/431 |
| 4,514,599 | A * | 4/1985 | Yanagishima et al. | 381/152 |
| 6,160,898 | A | 12/2000 | Bachmann et al. | 381/425 |
| 6,170,603 | B1 | 1/2001 | Bachmann et al. | 181/150 |
| 6,275,598 | B1 | 8/2001 | Bachmann et al. | 381/425 |
| 6,347,149 | B1 | 2/2002 | Bachmann et al. | 381/396 |
| 6,369,943 | B1 | 4/2002 | Bachmann et al. | 359/445 |
| 6,494,289 | B1 | 12/2002 | Bachmann et al. | 181/173 |
| 2001/0055403 | A1 | 12/2001 | Bachmann et al. | 381/190 |

FOREIGN PATENT DOCUMENTS

| | | |
|---|---|---|
| DE | 198 21 855 A1 | 11/1999 |
| DE | 198 21 862 A1 | 11/1999 |
| DE | 198 25 866 A1 | 12/1999 |

OTHER PUBLICATIONS

HAM-003us.
HAM-026us.
HAM-077us.
HAM-113us.
HAS-006.01 (Claims only; specification and figures in Document BI).
HAS-008.01 (Claims only; specification and figures in Document BJ).
HAS-010.01 (Claims only; specification and figures in Document BK).

* cited by examiner

*Primary Examiner*—Huyen Le
(74) *Attorney, Agent, or Firm*—Scott E. Kamholz; Foley Hoag LLP

(57) ABSTRACT

A flat panel loudspeaker arrangement with several panel loudspeakers of similar construction is disclosed. The panel loudspeakers are arranged seamlessly side-by-side and are rigidly connected with one another along their respective edges with a high shear strength. The panel loudspeakers can be supported by an existing stable wall.

6 Claims, 6 Drawing Sheets

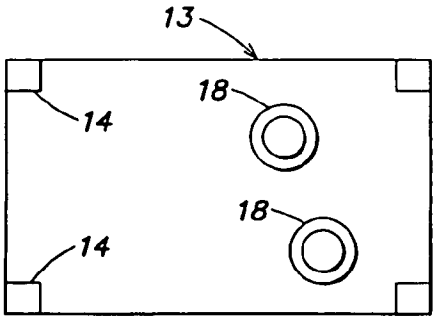
FIG. 5a1
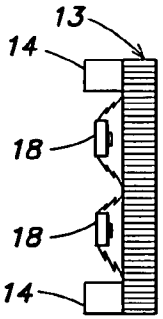
FIG. 5a2
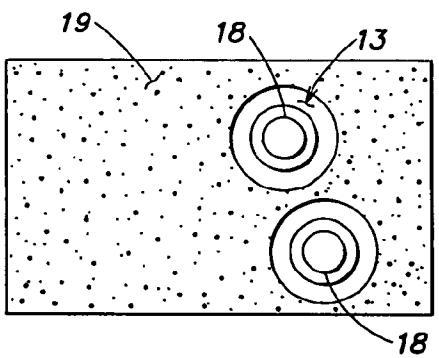
FIG. 5b1
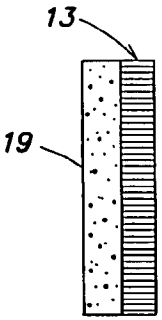
FIG. 5b2
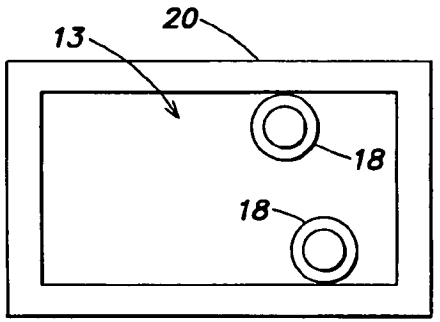
FIG. 5c1
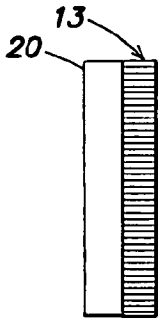
FIG. 5c2
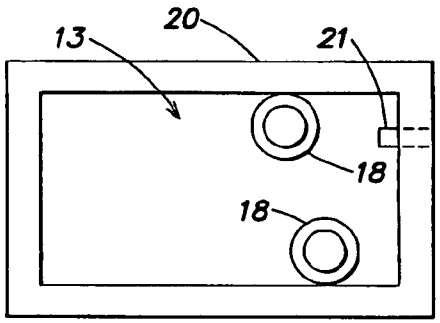
FIG. 5d1
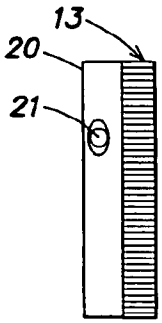
FIG. 5d2

FLAT PANEL LOUDSPEAKER ARRANGEMENT

CROSS REFERENCE TO RELATED APPLICATIONS

This application claims priority to German Patent Application Number DE 100 01 410.0 filed Jan 14, 2000.

FIELD OF THE INVENTION

The invention relates to a flat panel loudspeaker arrangement, and more particularly, to a flat panel loudspeaker arrangement made of similar panel loudspeakers that are positioned side-by-side and abut seamlessly.

BACKGROUND OF THE INVENTION

Panel loudspeakers essentially consist of a panel-shaped membrane (sound panel), a drive system (driver) and a support. The panel-shaped membrane should be light-weight and, more particularly, should resist bending. The drive system of panel loudspeakers typically includes one or more electromechanical (piezo-electric or preferably electrodynamic) converters. The support transmits the weight of the panel-shaped membrane and of the drive system to a rigid support member without inhibiting the intended movement of the membrane.

Conventionally designed panel loudspeakers (planar devices) operate below resonance, i.e., the panel constructed to operate in a frequency range below the first bending oscillation resonance. This operating mode is known from conventional cone loudspeakers and is frequently referred to as piston loudspeaker. Accordingly, as with the piston loudspeaker, bending oscillations of a planar device (rigid panel loudspeaker) are prevented (which necessitates a complex design).

Modern panel loudspeakers, on the other hand, operate at resonance, i.e., constructive measures are employed to ensure that the panel attains bending oscillation resonances when operating in the intended operating frequency range. This loudspeaker operating mode is also referred to as multi-resonance panel loudspeaker. Sometimes, the term "bending wave loudspeaker" is used which has multiple definitions as it could refer to both a multi-resonance panel loudspeaker and non-resonant absorber panels operating with bending waves. The conventional multi-resonance loudspeakers are almost exclusively panel-shaped, direct-radiating loudspeakers that can be used without a housing and can be installed, for example, as ceiling loudspeakers in suspended building ceilings or operated freestanding, like a sign stand with a base.

If a multi-resonance panel loudspeaker without a housing is placed close to a sound-reflecting wall (distance from the wall less than the panel diagonal, orientation parallel), then a decrease in the power is generally observed at low frequencies (wall effect). The "wall effect" can be lessened by shielding the multi-resonance panel loudspeaker with a rear-mounted flat housing. However, although this solution is adequate for small panels that are easy to handle, the bandwidth still suffers.

Large flat panel loudspeakers have theoretically the following advantages: a reduced lower cutoff frequency is attained through self-diffraction, with the additional advantage that the lowest panel resonance is are relatively low. In addition, large flat panel loudspeakers have a high sensitivity due to the large area of their membrane, since the radiated power is proportional to the membrane area and proportional to the square of the average effective acoustic velocity on the membrane. In addition, the small excursion of the drivers causes only relatively small nonlinear distortions. Also, with the large panel surface area, the square of the acoustic velocity can be made smaller while still being able to radiate the same acoustic power. Finally, the large area can also radiate a relatively high peak power.

Conversely, other large flat panel loudspeakers (planar devices, electrostatic devices and magnetostatic devices) all have the serious focusing problem: in the high frequency range, the solid angle narrows with the square of the ratio of wavelength to membrane diagonal. For example, with a distance of five meters between the listener and the loudspeaker, the ear of the listener would have to be positioned exactly on the mid-perpendicular of the panels with an accuracy of five centimeters. This can rarely be achieved in practice. Large electrostatic devices (flat panel loudspeakers with a soft membrane) require additional complex high power electronics operating at high-voltages. Large magnetostatic devices (also flat panel loudspeakers with a soft membrane) require large, expensive, heavy-weight flat magnet drivers which pose an additional disadvantage. Large planar devices (flat panel loudspeakers with a rigid membrane) are severely limited in their operating frequency band: the first bending wave resonance frequency which represents a significant cutoff frequency, decreases with the square of the panel diagonal.

Of the four operating modes of large flat panel loudspeakers being considered (planar, electrostatic, magnetostatic, multi-resonance panel loudspeaker), only the multi-resonance panel loudspeakers have all the aforedescribed advantages of large flat panel loudspeakers (cutoff frequency, sensitivity, distortion, power reserve) without the aforedescribed disadvantages (focusing effect, need for expensive high-voltage flat magnet drivers, limited operating frequency band). However, like with other large flat panel loudspeakers, selecting a suitable support structure also presents a problem with the multi-resonance panel loudspeakers. Large freestanding walls of any kind require expensive support and safety structures. As a result, only small to medium-size multi-resonance flat panel loudspeakers have been realized to date, with many of the aforedescribed advantages either absent or implemented only on a limited base.

It is therefore an object of the invention to provide a flat panel loudspeaker arrangement which eliminates the disadvantages described above.

SUMMARY OF THE INVENTION

The flat panel loudspeaker arrangement of the invention utilizes existing support structures (for example, building walls) as a support, so that large loudspeakers can be implemented while conserving construction material. Advantageously, rather than using a single large-area sound panel which is difficult to handle, individual panel loudspeakers are applied in a simple manner to a building wall, much like "tiles." The pleasant tonal response of the multi-resonance loudspeakers is mainly due to a bending wave operation above the coincidence frequency. This is achieved, for example, with a self-supported sound panel (for example, a sandwich panel) that is attached only along the edge. The flat panel loudspeaker arrangement according to the invention advantageously also eliminates the so-called "wall effect," so that the arrangement becomes quite simple while still capable of operating across the entire hi-fi bandwidth, i.e., both in a low-frequency piston operating mode as well as in a true high-frequency bending wave radiation mode. This is achieved by a flat panel loudspeaker arrangement with several panel loudspeakers which are arranged side-by-side without a gap in such a way that the individual panel loudspeakers (after installation on a predefined load-bearing mounting surface) are rigidly connected along the edge to the respective adjacent panel loudspeakers so as to resist shear forces.

Advantageously, each of the panel loudspeakers has a respective driver to produce oscillations, a sound panel and a support, and operates at high frequencies in a multi-resonance bending wave mode.

Particularly advantageous are sound panels which are implemented as self-supporting sandwich panels with low damping and a light core that resists shear forces, and a front and/or rear cover layer that is connected to the core over the entire surface area. The individual panel loudspeakers and the entire "wall cover" composed of the individual panel loudspeakers attains the necessary mechanical stability predominantly through the distinct installation (mounting).

For the purpose of attaching the panel loudspeakers, the drivers can be connected to the backside of the sound panel, with the backside of the drivers designed so that the panel loudspeakers can be attached to a specified surface, such as a wall. In this case, the drivers can be electrodynamic and/or piezoelectric drivers that can be either inserted in or attached to the backside of the sound panel.

Preferably, the backside of the sound panel has a profiled, distance-maintaining structure (spacer profile) which can self-supportingly hold the sound panel. The backside of the spacer profile can be adapted to be secured to a suitable surface (for example a wall of a room). The spacer profile can also include several spacer elements or a pad made of a soft material (for example, expanded foam) which is affixed to the entire backside of the sound panel. When using a pad as a spacer profile, the pad preferably includes recesses for the driver(s). This facilitates the installation of the individual panel loudspeakers on a suitable surface (for example a wall).

The spacer profile can also include a circumferential, hermetically sealing bead that contacts the surface provided for installation. This arrangement improves the reproduction of the bass frequencies.

To further enhance reproduction of the bass frequencies, the resonance volume can be designed to include a vent opening, which is preferably implemented as a bass reflex tube. The bass reflex tube can also be arranged as a floating tube in the sound panel itself. In this way, the bass reflex tube need not pass through the lateral edge of the spacer profile, but can be vented to the front. The floating tube can advantageously be fixedly secured in an opening of the sound panel, wherein the opening in the sound panel can be pre-stamped, but remains sealed. The user can then select operation with or without the bass reflex tube.

In an alternative attachment of the bass reflex tube, the tube is mounted with a rear-facing mounting flange on the installation surface, with one or more openings providing a connection with the enclosed air volume. The opening in the sound panel should be larger than the tube diameter so that an annular gap remains after the tube is inserted. However, the gap should preferably be sealed airtight, for example, with a thin foil, without transmitting oscillations and without blocking the bending oscillations of the sound panel. The opening can in the sound panel can also be pre-stamped without being sealed off, so that the user can insert the tube if desired.

The panel loudspeakers may have the same impedance and are preferably connected in form of a bridge network. The bridge network is designed so that the electric impedance of the entire system is preferably in the range of the impedance of typical commercial loudspeakers (for example, 4 to 8 Ohm).

Further features and advantages of the present invention will be apparent from the following description of preferred embodiments and from the claims.

BRIEF DESCRIPTION OF THE DRAWINGS

The following figures depict certain illustrative embodiments of the invention in which like reference numerals refer to like elements. These depicted embodiments are to be understood as illustrative of the invention and not as limiting in any way.

DETAILED DESCRIPTION OF CERTAIN ILLUSTRATED EMBODIMENTS

Figure 1:
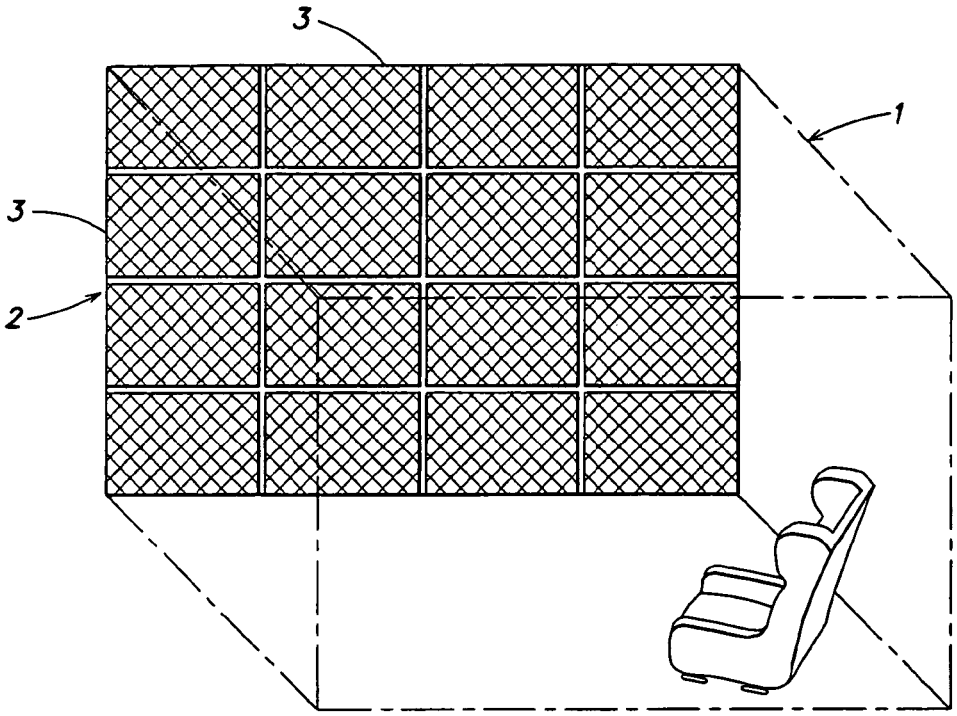
FIG. 1 shows a first embodiment of a flat panel loudspeaker arrangement according to the invention in a typical application.
Figure 2:
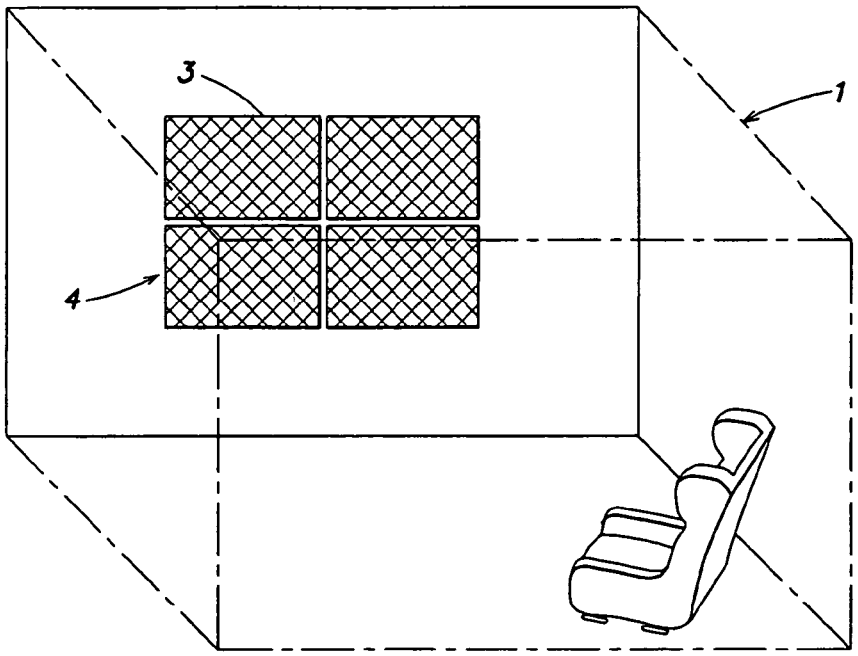
FIG. 2 shows a second embodiment of a flat panel loudspeaker arrangement according to the invention in a typical application.

According to one aspect of a flat panel loudspeaker according to the invention, the flat panel loudspeaker can be easily attached by taking advantage of the stability of the available mounting surfaces, for example the walls of a building, a room and the like. According to another aspect, logistical problems can be easily overcome, such as adequately handling a loudspeaker that has the size of a wall and is made of breakable materials during production, transport and installation. FIGS. 1 and 2 show typical applications in a schematically illustrated auditorium 1, such as a living room, a studio, an office, a music hall and the like. In the embodiment of FIG. 1, a wall of the auditorium 1 is completely covered by a flat panel loudspeaker arrangement operating as a wall radiator system 2. In the embodiment of FIG. 2, a wall radiator system 4 only covers a portion of a wall. In both embodiments, the wall radiator systems 2 and 4, respectively, are subdivided into individual wall radiator elements 3. The wall radiator system 2 is constructed of sixteen wall radiator elements 3, whereas the wall radiator system 4 is constructed of four individual wall radiator elements 3. The seams between the individual wall radiator elements 3 of the wall radiator systems 2 and 4 can be designed so that they are invisible after installation.

Figure 3:
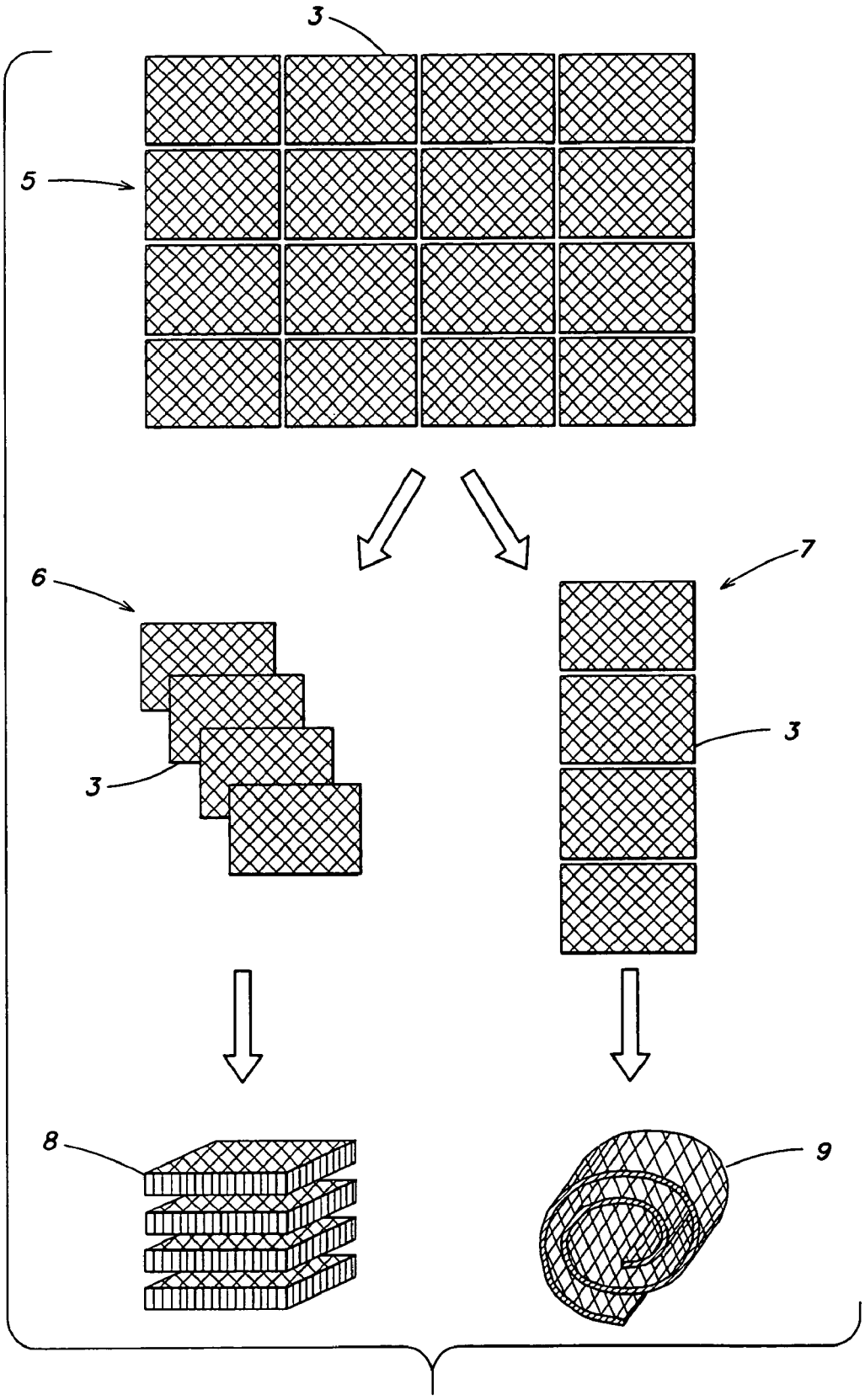
FIG. 3 shows the flat panel loudspeaker arrangement of the invention adapted for transport.

FIG. 3 shows the logistical problems associated with a flat panel loudspeaker arrangement of the invention. Since a complete wall radiator system 5 is difficult to transport and to install, the flat panel loudspeaker arrangement of the invention is subdivided into the individual wall radiator elements 3 which can be, for example, assembled (6) into a stack 8 or manufactured in form of juxtaposed wall radiator webs 9 and transported (7).

Figure 4A:
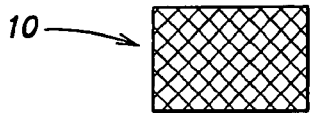
FIGS. 4A–C show an individual panel loudspeaker for a flat panel loudspeaker arrangement according to the invention, FIGS. 5A1–A2, B1–B2, C1–C2, and D1–D2 show different spacer profiles for a panel loudspeaker for a flat panel loudspeaker arrangement according to the invention.
Figure 4B:
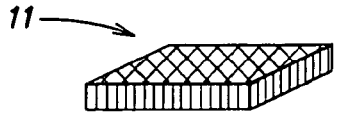
Figure 4C:
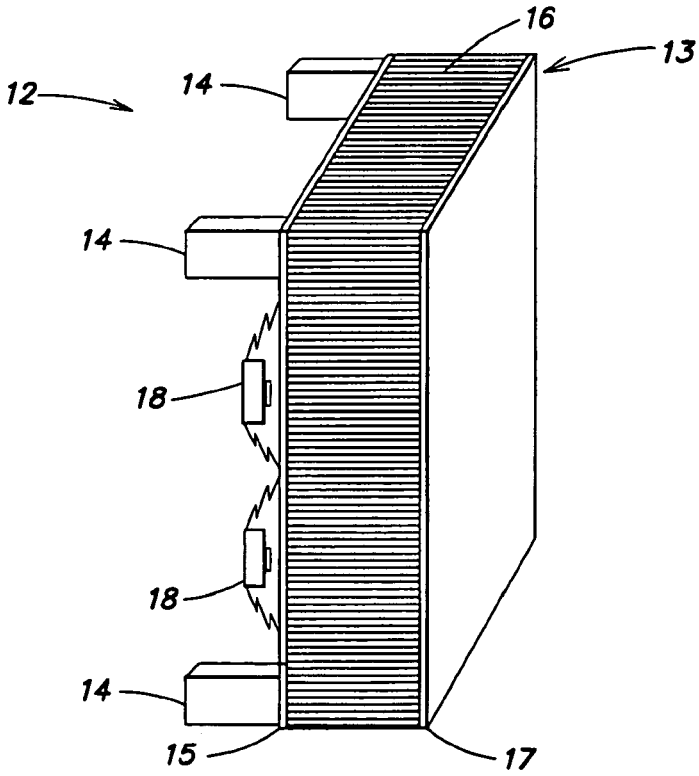

FIG. 4A shows a top view 10 and FIG. 4B a perspective view 11 of a wall radiator element (similar to a "tile") without revealing details. An enlarged, more detailed perspective view 12 of the wall radiator element in FIG. 4C also shows a multi-resonance sound panel 13 and support devices 14 (spacer profile). The multi-resonance sound panel has low damping and is self-supported (for example, by a support device 14 formed as support feet and located at the corners of the multi-resonance sound panel 13). The multi-resonance sound panel 13 is made of a hard, almost brittle material which provides overall the highest possible bending stiffness at the lowest possible mass coverage. In the exemplary embodiment, expanded foam panels (with or without cover layers) or honeycomb sandwich panels are used. When honeycomb sandwich panels with a rear cover layer 15, a core 16 and a front cover layer 17 are used, the cover layer material should have the highest possible dilatational wave velocity, whereas the core material should have the lowest possible average density in combination with the highest possible average shear module. The illustrated arrangement together with the drivers 18, which can be mounted on or inserted in the rear surface of the multi-resonance sound panel 13, represents a complete multi-resonance loudspeaker.

The stability of the solid mounting surfaces (for example, a building wall in an interior space of a building) and the uniform environmental condition in the room make it feasible to fabricate the multi-resonance panel loudspeaker inexpensively by a simple process. For example, the cover layers can be made of paper and the sandwich core of expanded foam with open pores. The spacer profile 14 disposed between the self-supporting multi-resonance sound panel 13 and a wall, which is not shown in detail in FIG. 4, performs an important function with the multi-resonance panel loudspeaker. The spacer element is used to support the free-standing multi-resonance sound panel 13 having a sandwich construction and should be able to withstand the static shear force caused by the weight of the panel without impeding oscillations of the multi-resonance panel 13 in a direction normal to the wall surface. The spacer profile 14 can be implemented in many ways to perform the desired function. FIGS. 5A1–A2, B1–B2, C1–C2, and D1–D2 depict several preferred embodiments.

In the embodiment illustrated in FIGS. 5A1–A2, the spacers are in form of solid or soft-elastic supports attached at free locations of the multi-resonance sound panel 13. The underside of the spacers is adapted for attachment parallel to the wall surface. This arrangement creates a shallow cavity behind the arrayed "tile layer" of multi-resonance sound panels. The cavity is open at the common edge and has its own low-frequency resonances.

In the embodiment of FIGS. 5B1–B2, the spacer profile 14 is a soft foam panel 19, which has openings for structures, for example the drivers 18, that may protrude from the rear side from the multi-resonance sound panel 13. The pad 19 is glued to the multi-resonance sound panel 13, with the side of the pad facing away from the sound panel adapted for attachment to a mounting wall (not shown). This arrangement creates a shallow cavity behind the arrayed "tile layer" of multi-resonance sound panels. The cavity is open at the common edge and has its own low-frequency resonances.

The embodiment depicted in FIGS. 5C1–C2 shows a "box"-like structure. A circumferential bead 20 along the edge is provided to not only support the multi-resonance sound panel 13, but to also create a closed resonance cavity when the wall radiator element is attached to a wall (not shown in FIGS. 5C1–C2). The cavity is formed independent of the presence of additional wall radiator elements.

The embodiment of FIGS. 5D1–D2 is similar to the embodiment of FIGS. 5C1–C2, but includes in addition a base reflex tube 21 located on one side of the circumferential edge bead 20. The circumferential edge bead 20 not only supports the multi-resonance sound panel 13, but also creates a closed resonance cavity when the wall radiator element is attached to a wall, with the cavity being vented through an acoustically effective opening. At low frequencies, each of the multi-resonance sound panels operates like a piston loudspeaker, i.e., all surface areas are moving with the same phase. Under these conditions, an enclosed air volume that is not vented would significantly increase the restoring force and consequently also the impedance, thereby inhibiting the radiated acoustic power at low frequencies. Instead of a base reflex tube, a suitability formed horn or a transmission line can be used as a vent. A lateral vent opening, however, should only be considered when the number of wall radiator elements is small.

Figure 6:
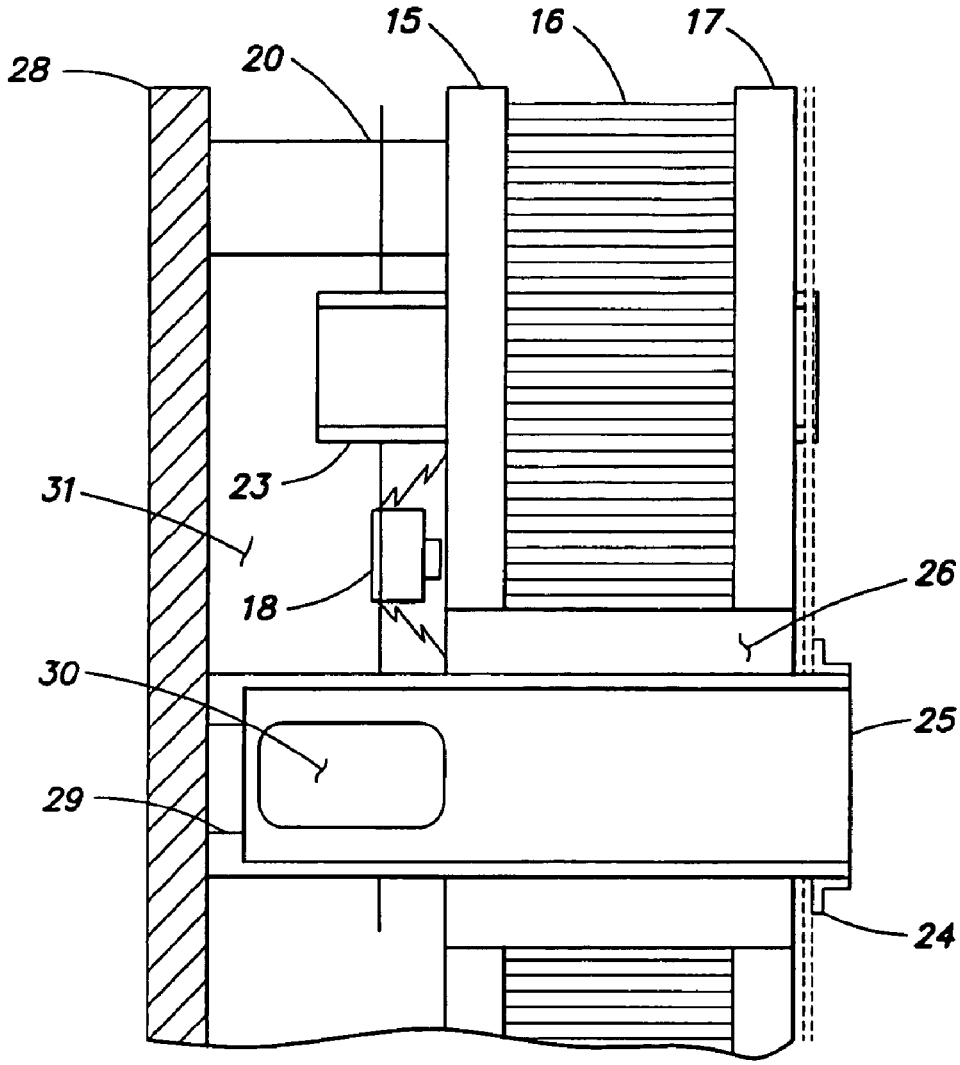
FIG. 6 shows a floating bass reflex tube for a flat panel loudspeaker arrangement according to the invention.

If a wall radiator is formed of a larger number of wall radiator elements, then vent openings to the front surface are preferred. A front vent opening, for example, can have the form of openings provided in the multi-resonance sound panel itself. FIG. 6 shows in cross-section a portion of a wall radiator element with a spacer profile 20 in the form of a circumferential bead. The enclosed air volume is vented through one or more bass reflex tubes 23, 25. Two embodiments are preferred, namely a floating tube and a stationary tube.

In the simplest case, when using a floating tube, a bass reflex tube 23 is inserted after the individual arrayed wall radiator elements are mounted on the wall. The bass reflex tube 23 is secured in a suitable opening of the sound panel and internally coupled to the enclosed air volume 31 while open to the building wall 28. The bass reflex tubes of different wall radiator elements can be tuned differently to enhance the bass reproduction over a broad frequency range. The panel surface can be factory-designed so that it can be easily opened by the user.

When using a stationary tube, the reflex tube can be decoupled from the floating sound panel by providing in each wall radiator element a hermetically sealed annular gap 26 that is decoupled from the oscillations. A tube 25 is inserted into all or into only selected wall radiator elements after the wall radiator elements are installed. In the illustrated embodiment, a tube with a base flange 29 proximate to the building wall 28 is coupled internally to the air volume 31 through a window 30. An cover ring 24 connects with the foil of the bass reflex tube and centers the bass reflex tube. The bass reflex tubes 25 located in different wall radiator elements can also be tuned differently to enhance the bass reproduction over a broad frequency range.

The first resonances of the air volume between the sound panel and the building wall exhibit a acoustic velocity polarization parallel to the wall. The associated scalar pressure distribution is coupled with a membrane deflection that is polarized normal to the wall. The large edge dimensions defined by the housing wall can only be taken advantage of if the wall radiator elements which are initially isolated from each other are coupled to one another with a low loss.

The tonal response of the wall loudspeakers can be fully utilized if a plurality of wall radiator elements are coupled to one another so as to enable a low-friction pressure equalization at low frequencies. For this purpose, the airtight circumferential separation wall 20 between the tiles to be coupled is provided with large openings during installation. Alternatively, the circumferential tile separation wall (bead 20) can be made of a material with a honeycomb structure, with the axes of the honeycomb cells extending parallel to the plane of the sound panel. In this case, it is only necessary to remove an insulating strip (for example, an air-tight adhesive tape of a suitable width that resists bending) from the butt joint between the wall radiator elements that are to be coupled. The adhesive tape is applied during production to provide air-tightness.

Because the wall loudspeaker is partitioned into several individual wall radiator elements and the wall radiator elements are preferably of similar construction, the loudspeaker system that is mounted on a wall has preferably a periodic structure. The periodic structure is preferably also maintained when the individual wall radiator elements are interconnected.

Figure 7A:
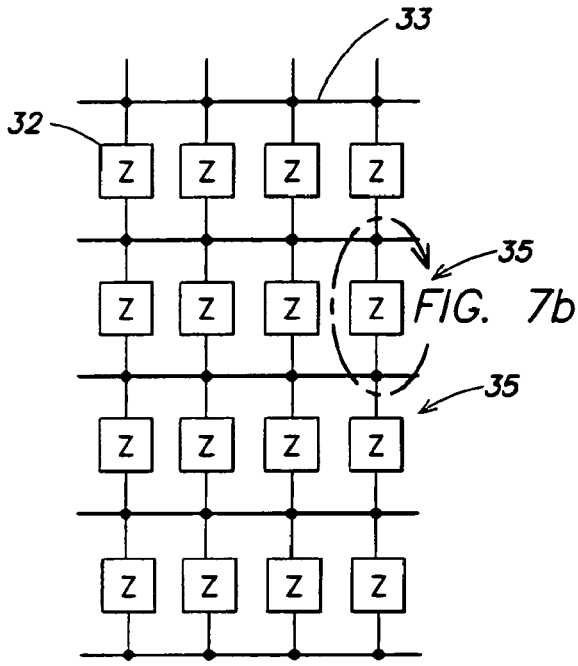
FIG. 7 shows a wiring diagram of individual panel loudspeakers for a flat panel loudspeaker arrangement according to the invention.

FIG. 7*a* shows the electrical connection of wall radiator elements for an exemplary loudspeaker system with 4×4=16 wall radiator elements. By connecting the wall radiator elements in form of a matrix (series and parallel connection), the total impedance of the loudspeaker system is equal to the impedance of a single radiator element. If the wall radiator elements are not arranged in a square, then the total impedance may be slightly different from the impedance of a single radiator element.

Figure 7B:
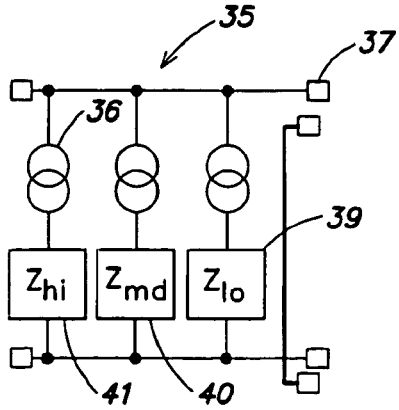

FIG. 7*b* shows in detail the internal electric connections of a wall radiator element 35. In the simplest case, the driver system in a wall radiator element may include a single driver. More expensive systems (as depicted in FIG. 7*b*) may include an assembly of a high-frequency driver 41, a mid-range driver 40 and a low-frequency driver 39 as well as associated decoupling filters 36. The driver elements of a wall radiator element are typically hardwired, with each element 32 having an impedance Z. After wall mounting, each wall radiator element has a conventional electrical impedance and can hence be operated as an individual loudspeaker. The corresponding control signal is applied to the contacts 37 of the respective wall radiator element.

Figure 7C:
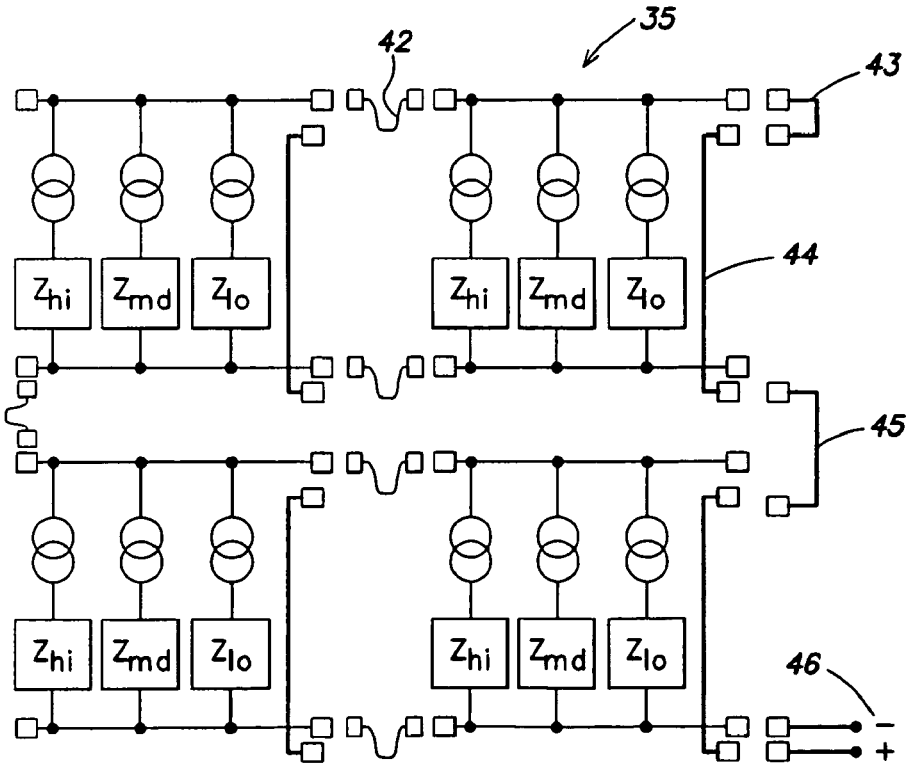

FIG. 7*c* shows a portion of the network of FIG. 7*a*, illustrating how the individual wall radiator elements can be connected with one another. Also shown are horizontally extending exemplary single-pole bus connectors 42. Due to the symmetry in the circuit of the illustrated embodiment, the bus connectors 42 typically do not carry current. However, the symmetry is destroyed if a wall radiator element fails, in which case the horizontal bus connectors 42 carry current and the network continues to operate—with slight limitations—due to its redundancy. Hence, the loudspeaker system has static fail-safe provisions. Aside from the horizontal bus connectors 42, the network has also vertical bus connectors 44. The bus connectors 42 and 44 are connected between horizontal and vertical jumpers 42 and 45, starting from a main terminal 46 and extending throughout the entire wall loudspeaker system. A vertical bus jumper 43 is provided for connecting the vertical bus.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed is:

1. Flat panel loudspeaker arrangement comprising:

a plurality of panel loudspeakers operating according to the multi-resonance bending wave principle, each loudspeaker comprising:

at least one driver that produces oscillations; and a sound panel, having a backside that includes a spacer profile which:

is capable of holding the sound panel without additional support; and includes a pad made of a soft material that is affixed to the back surface of the sound panel and includes openings for the at least one driver;

the loudspeakers being positioned side-by-side and abutting seamlessly, wherein respective adjacent panel loudspeakers are rigidly connected with one another along respective edges so as to provide a high shear strength.

2. The flat panel loudspeaker arrangement of claim 1, wherein the sound panel is a self-supporting panel with low damping and implemented as a sandwich structure with a light, shear-resistant core and at least one cover layer which is completely connected to the core.

3. The flat panel loudspeaker arrangement of claim 1, wherein one side of the at least one driver is connected to the backside of the sound panel, with another side of the driver facing away from the one side being adapted for attachment of the panel loudspeakers on a mounting surface.

4. The flat panel loudspeaker arrangement of claim 1, wherein a side of the spacer profile facing away from the sound panel can be attached to a mounting surface.

5. The flat panel loudspeaker arrangement of claim 1, wherein the pad is affixed to the entire back surface of the sound panel.

6. The flat panel loudspeaker arrangement of claim 1, wherein the panel loudspeakers are electrically connected in form of a bridge network.

* * * * *